US006193534B1

(12) United States Patent
Burwell et al.

(10) Patent No.: US 6,193,534 B1
(45) Date of Patent: Feb. 27, 2001

(54) NON-ARCING FLUORESCENT LAMP HOLDER

(75) Inventors: John W. Burwell, Rome City; James M. Gust, Wolcottville, both of IN (US)

(73) Assignee: Lyall Assemblies, Inc., Albion, IN (US)

( * ) Notice: Subject to any disclaimer, the term of this patent is extended or adjusted under 35 U.S.C. 154(b) by 0 days.

(21) Appl. No.: 09/397,535

(22) Filed: Sep. 16, 1999

Related U.S. Application Data

(63) Continuation-in-part of application No. 09/176,682, filed on Oct. 21, 1998.

(51) Int. Cl.[7] ..... H01R 33/02

(52) U.S. Cl. ..... 439/226; 439/236

(58) Field of Search ..... 439/226, 168, 439/182, 220, 236, 242; 313/33, 54, 493; 362/222, 223, 294, 373

(56) References Cited

U.S. PATENT DOCUMENTS

| | | | | |
|---|---|---|---|---|
| 4,147,947 | * | 4/1979 | Hoeh | 313/27 |
| 4,275,325 | * | 6/1981 | Guim | 313/51 |
| 4,352,539 | * | 10/1982 | Vest | 339/154 L |
| 4,906,891 | * | 3/1990 | Takagi et al. | 313/318 |
| 5,140,216 | * | 8/1992 | Darr | 313/25 |
| 6,113,408 | * | 9/2000 | Burwell et al. | 439/226 |

* cited by examiner

*Primary Examiner*—Brian Sircus
*Assistant Examiner*—Chandrika Prasad
(74) *Attorney, Agent, or Firm*—Taylor & Aust, P.C.

(57) ABSTRACT

A fluorescent lamp holder assembly is adapted to receive various injection molded end cap structures allowing the fluorescent lamp holder assembly to have several embodiments, including watertight embodiments. The fluorescent lamp holder assembly may be disposable or may allow replacement of the fluorescent lamp, with the replacement style being watertight. The fluorescent lamp holder assembly generally includes a fluorescent lamp surrounded by a protective sleeve. A first end cap covers a first end of the lamp and sleeve, while a second end cap structure comprising a power connector cap and tube power connector cap covers a second end of the lamp and sleeve. In one embodiment, the protective sleeve is a structure that includes inner and outer co-axial tubes with a plurality of spacers or creases therebetween and/or therein defining a plurality of chambers defining a plurality of air pockets. The air pockets provide insulation for assisting in cold starting of the fluorescent lamp. Electrical leads that extend between the end caps may be carried by one of the air pockets or be integral with one of the inner and outer tubes as strip conductors. In another form, a ballast may be integrally incorporated into an end cap of the fluorescent lamp assembly. The end cap would be releasably retained onto the fluorescent lamp assembly and be couplable to a source of electric power.

29 Claims, 4 Drawing Sheets

NON-ARCING FLUORESCENT LAMP HOLDER

CROSS-REFERENCE TO RELATED APPLICATIONS

This application is a continuation-in-part of copending application Ser. No. 09/176,682, entitled "NON-ARCING FLUORESCENT LAMP HOLDER", filed Oct. 21, 1998.

BACKGROUND OF THE INVENTION

1. Field of the Invention

The present invention relates to lamp holders, and, more particularly, to fluorescent lamp holders.

2. Description of the Related Art

Fluorescent lamps, as known, include a glass tube coated on the inside with phosphor powders which fluoresce when exited by ultraviolet light. The glass tube is filled with rare gases (such as argon, neon, and krypton) and a small amount of mercury, and operates at a relatively low pressure. Electrodes are mounted within the glass tube and emit electrons during operation. The electrons are accelerated by the voltage across the tube until they collide with mercury atoms, causing the mercury atoms to be ionized and excited. When the mercury atoms return to their normal state, photons corresponding to mercury spectral lines in both the visible and ultraviolet region are generated, thereby exciting the phosphor coating on the inside of the tube to luminance.

To start a fluorescent lamp, electron emission from the electrodes may be induced in one of two ways. First, a filament electrode may be heated by passing current therethrough. Secondly, a high voltage which is sufficient to start an electric discharge in the lamp may be applied across the lamp without preheating the electrodes. Instant start circuits which are commonly used today typically employ the latter method of inducing electron emission from the electrodes. Instant start circuits use a ballast which applies a high voltage (e.g., up to 848 VAC) at a high frequency. Such instant start ballasts are much more energy efficient than older style ballasts which heat the electrodes. The ballasts are wired from their mounting location to a fluorescent lamp assembly.

Such fluorescent tubes come in a variety of styles and thus are used in a variety of applications. One such application is in commercial refrigeration illumination. Generally, a fluorescent lamp holder or assembly for such applications includes a fluorescent lamp surrounded by a protective plastic tube that are both retained on each end by a cap structure. One cap structure covers terminals on one end of the fluorescent lamp and the connection wires. The other cap structure couples the terminals of the other end of the fluorescent lamp to electrical power, generally by a power cord. Wires run the length of the protective plastic tube for appropriate connection to the terminals on the other end of the fluorescent lamp. Each cap structure is retained to the protective plastic tube by metal clips. The lamp assembly is generally retained within the refrigerator or freezer by clips. The power cord from the lamp assembly is wired into the power of the refrigerator. The above fluorescent lamp holder is, by its nature, disposable and not waterproof. Replacement of the fluorescent tube in the prior art holders is usually not recommended. Further, when the fluorescent lamp goes out, the entire holder must be unwired, with a new holder to be rewired. Additionally, because the lamp assemblies are typically disposed in a cold environment, start-up of the fluorescent lamp may be difficult.

What is needed in the art is a fluorescent lamp holder which prevents electrical arcing between a conductor of the lamp holder and the contact pins of a fluorescent lamp.

What is also need in the art is a fluorescent lamp holder that is waterproof for use in a moisture-laden environment.

Further needed in the art is a fluorescent lamp holder that allows replacement of the fluorescent lamp.

Still further needed in the art is a fluorescent lamp assembly that provides thermal insulation for the fluorescent lamp relative to the ambient environment.

Still even further needed in the art is a fluorescent lamp assembly that functions better in cold environments.

SUMMARY OF THE INVENTION

In accordance with one aspect of the present invention, there is provided a fluorescent lamp holder assembly adapted to accept various end cap structures.

In one form thereof, the fluorescent lamp holder is disposable. A protective sleeve surrounds the fluorescent lamp. A first end cap structure receives the fluorescent tube and protective sleeve and covers the wire connections to one set of terminals of the fluorescent tube. Preferably, the first end cap is permanently attached to the protective sleeve. A second end cap structure receives the other end of the protective sleeve and fluorescent tube and is comprised of a power attachment cap portion and a tube power connector cap portion. The power attachment cap portion receives one set of terminals of the fluorescent lamp and provides electrical coupling between the two sets of terminals of the fluorescent lamp with a source of electrical energy and is attached to the sleeve via an attachment chip. The tube power connector cap portion couples to the power attachment cap portion and provides a holder for the fluorescent tube and a pathway for the electrical wires for the second set of terminals. Preferably, the tube power connection cap portion is permanently attached to the protective sleeve.

In another form thereof, the fluorescent lamp holder provides replacement of the fluorescent tube. A first end cap structure includes terminal receptacles for receipt of one set of fluorescent lamp terminals. The receptacles are in communication with power wires of the holder and is preferably permanently attached to the protective sleeve. A second end cap structure includes a tube power attachment cap portion and a power attachment cap portion. The power attachment cap portion receives one set of terminals of the fluorescent lamp and provides electrical coupling between the two sets of terminals of the fluorescent lamp with a source of electrical energy. The tube power connector cap portion couples to the power attachment cap portion and provides a holder for the fluorescent tube and a pathway for the electrical wires for the second set of terminals. Preferably, the tube power connection cap portion is permanently attached to the protective sleeve.

In accordance with another aspect of the present invention, there is provided a fluorescent lamp assembly having a sleeve structure that provides thermal insulation for the fluorescent lamp.

In one form, the protective sleeve structure comprises an inner tube surrounded by an outer tube which are sized appropriately such that a cavity is defined between the outer diameter of the inner tube and the inner diameter of the outer tube. Spacers are disposed in the cavity to define chambers that form air pockets between the tubes.

The spacers may be formed on the outer diameter of the inner tube and/or on the inner diameter of the outer tube. The spacers are preferably radially positioned about the respective diameter and extend longitudinally along the tube to define a plurality of longitudinal chambers.

The spacers may take the form of radially outwardly extending ribs or as radially inwardly extending creases or folds. Electrical energy is distributed through the sleeve structure by conductors that extend through one or more of the chambers. As well, the conductors may be formed in a tube as an integral strip conductor.

In accordance with yet another aspect of the present invention, there is provided a fluorescent lamp assembly having a ballast integral with an end cap of the fluorescent lamp assembly. Heat generated by the ballast is provided to the fluorescent lamp, enhancing its operation.

In one form, the end cap is the power end cap having the ballast formed therein. The power cord is wired to the ballast while the ballast is wired to a plurality of receptacles formed in the power end cap. The power end cap receptacles receive prongs of the fluorescent tube and prongs of the connecting wires as the power end cap receives the fluorescent lamp stick.

It is an advantage of the present invention that various types of end cap structures may be used to provide various lamp assembly characteristics.

It is another advantage of the present invention that the lamp holder can be waterproof.

It is yet another advantage of the present invention that the lamp holder can be made disposable or replaceable.

It is another advantage of the present invention that various parts are injection molded, providing in one embodiment a watertight construction.

It is further an advantage of the present invention that one embodiment allows replacement of the fluorescent lamp to eliminate waste and the inconvenience of removing an old lamp holder and installing a new lamp holder.

It is still further an advantage of the present invention that is usable with a variety of fluorescent tube styles.

It is even further an advantage of the present invention that the fluorescent lamp can be insulated for faster start-ups in cold environments.

It is another advantage of the present invention that one embodiment of the fluorescent lamp assembly allows quicker assembly time.

It is yet another advantage of the present invention that one embodiment of the fluorescent lamp may utilize heat generated by a ballast in the end cap of the fluorescent lamp assembly.

It is further an advantage of the present invention that one embodiment of the fluorescent lamp assembly allows for easy replacement of the ballast.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate preferred embodiments of the invention, and such exemplifications are not to be construed as limiting the scope of the invention in any manner.

DETAILED DESCRIPTION OF THE INVENTION

Figure 1:
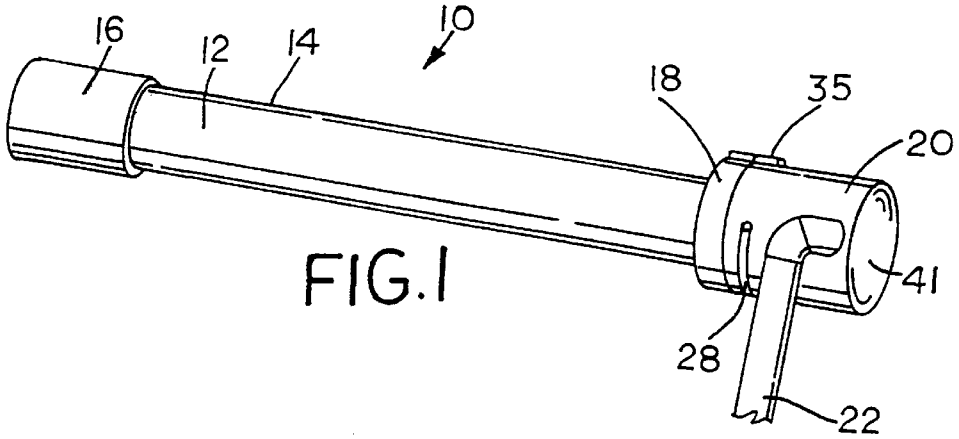
FIG. 1 is a perspective view of a generic embodiment of the present fluorescent tube holder.

Referring now to FIG. 1 there is shown a fluorescent lamp holder/assembly generally designated 10. Fluorescent lamp holder 10 includes a fluorescent tube or lamp 12 that is radially surrounded by a protective sleeve, tube or cylinder 14 that is preferably made of a light-transmissive plastic. Fluorescent lamp 12 and sleeve 14 are received at one end thereof in end cap 16. The other end of the fluorescent lamp 12 and sleeve 14 are received in tube power connector cap 18 which is coupled to power attachment cap 20. Electrical power is provided to fluorescent lamp holder 10 via power cord 22 coupled to power attachment cap 20, wherein power cord 22 is wired to or in communication with a source of electrical power. Attachment clip 28, preferably of metal, is used to retain power attachment cap 20 to sleeve 14.

While not shown, fluorescent lamp 12 has two conventional electrical leads, terminals, prongs or the like on either end thereof for attachment to appropriate electrical leads or wires supplying the necessary electrical power.

Figure 2:
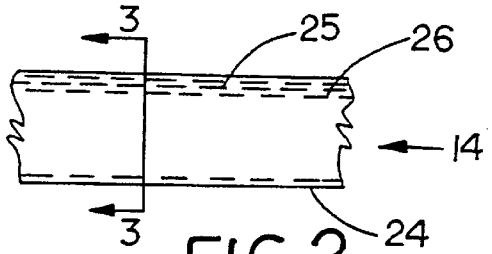
FIG. 2 is a partial side view of the outer tube of the present fluorescent tube holder.
Figure 3:
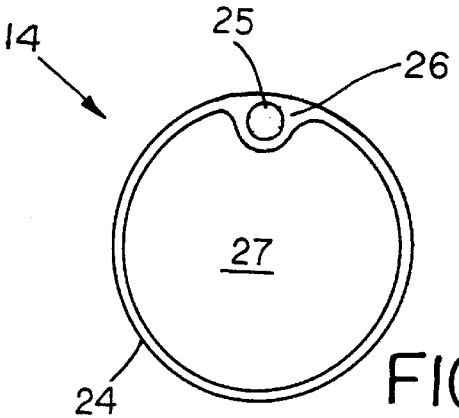
FIG. 3 is a sectional view along line 3—3 of FIG. 2.

With reference to FIGS. 2 and 3, there is shown sleeve 14 in greater detail. Sleeve 14 is defined by an elongated tubular wall 24 having a longitudinally disposed thick portion 26 along the elongated length of sleeve 14. Bore or shaft 25 is disposed in thick portion 26 and thus extends the entire elongated length of sleeve 14. Tubular wall 24 defines an inner cavity or hollow 27 in which fluorescent lamp 12 is received.

Figure 4:
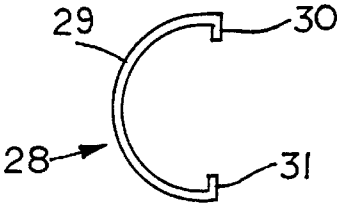
FIG. 4 is a side view of an attachment clip used in the present fluorescent tube holder.

FIG. 4 depicts attachment clip 28 which is defined by an arcuate or semi-circular portion 29 having radially inward flange 30 on one end thereof, and radially inward flange 31 on another end thereof, and may be used to secure the various caps to sleeve 14. Flanges 30 and 31 are received in respective openings (see below) in the particular cap and engage sleeve 14 for positive retention.

Figure 5:
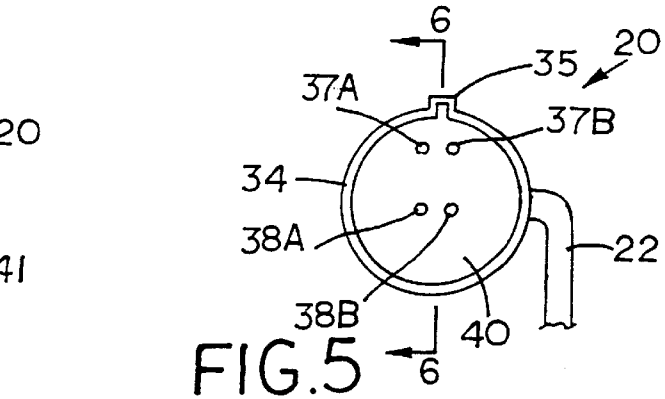
FIG. 5 is a front view of the power coupling end cap of the present invention.
Figure 6:
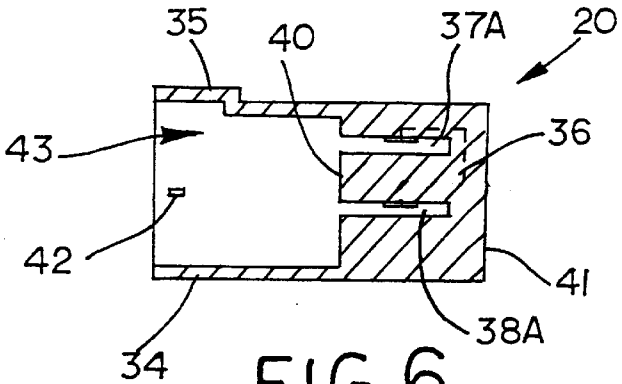
FIG. 6 is a cross-sectional side view of the power coupling end cap as taken along line 6—6 of FIG. 5.

With reference to FIGS. 5 and 6, there is depicted power attachment cap 20 which is preferably injection-molded made from a suitable dielectric material such as plastic. Power attachment cap 20 is defined by a generally cylindrical body 34 having a radially outward notch 35 in a front portion thereof and end block 36. End block 36 defines inner surface 40 in which are disposed two power cable bores 37*a* and 37*b* as well as tube prong receptacles bores/tube power connection bores 38*a* and 38*b*. Power cable bores 37*a* and 37*b* and tube prong receptacles 38*a* and 38*b* are in communication with power cable 22 for supplying electrical power to fluorescent lamp 12. Opening 42 is disposed in body 34 which along with a diametrically opposite opening (not shown) allow the use of attachment clip 28.

In accordance with the present invention, sleeve 14 and power attachment cap 20 are generic with respect to the various achievable embodiments of fluorescent lamp holder 10.

Figure 9:
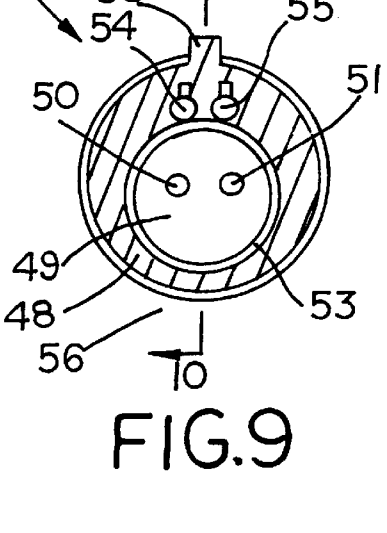
FIG. 9 is a front view of one embodiment of a tube power connector cap as taken along line 9—9 of FIG. 10.
Figure 10:
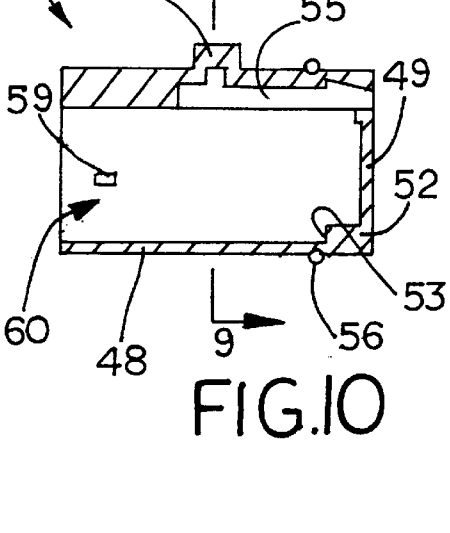
FIG. 10 is a cross-sectional side view of the tube power connector cap of FIG. 9 taken along line 10—10 thereof.

With reference now to FIGS. 7–10 there is depicted end cap 16*a* and tube power connector cap 18*a* which, along with sleeve 14 and power attachment cap 20, provide a disposable embodiment of fluorescent lamp holder 10. In particular, FIGS. 7 and 8 end cap 16*a*. End cap 16*a* is defined by tubular shell 44 having end portion 45, preferably injection-molded made from a dielectric plastic, and is sized to receive an end portion of sleeve 14 and fluorescent lamp 12 within opening 46. Electrical leads (not shown) that extend through bore 15 of sleeve 14 are attached to the fluorescent lamp terminals that are covered by end cap 16*a*. Preferably, end cap 16*a* is permanently attached to sleeve 14 via glue, sonic welding, or the like. FIGS. 9 and 10 depict tube power connector cap 18*a*, preferably made from a dielectric plastic, which is defined by cylindrical shell 48 having end wall 49. Tube power connector cap 18*a* has internal cavity 60 sized and dimensioned to receive fluorescent lamp 12 and sleeve 14 therein. End wall 49 includes two fluorescent lamp prong/terminal bores 50 and 51 through which the prongs/terminals (not shown) of the appropriate fluorescent lamp extend. Adjacent end wall 49 is radial ledge 52 which defines a front surface 53 that provides a stop for the fluorescent lamp when the fluorescent lamp is received therein. Ledge 52 is sized to allow the fluorescent lamp terminals/prongs (not shown) to sufficiently extend through bores 50 and 51 such that the fluorescent lamp terminals/prongs are receivable into bores 38*a* and 38*b* of power attachment cap 20 when assembled. Tube power connector cap 18*a* further includes electrical lead bores 54 and 55 that allow the electrical leads emanating from power attachment cap 18 to extend therein and feed through shaft 25 of sleeve 14 to couple with the fluorescent lamp terminals/prongs disposed within end cap 16*a*. Preferably, tube power connector cap 18*a* is permanently attached as by glue, sonic weld, or the like to sleeve 14 and when assembled, abuts power attachment cap 20. In this regard, tube power connector cap 18*a* has radially outward notch 58 that provides a stop and abuts notch 35 of power attachment cap 20. Additionally, O-ring 56 is provided for sealing as power attachment cap 20 extends over and around tube power connector cap 18*a* via opening 43. Two openings, of which one opening 59 is shown, provides attachment points for attachment clip 28 if used.

As tube power connector 18*a* joins with power connector cap 20, the fluorescent lamp terminals (not shown) that extend through bores 50 and 51 of end wall 49 of tube power connector 18*a* are received in bores 38*a* and 38*b* of power connector cap 20.

Thus, by using end cap 16*a* and tube power connector cap 18*a*, along with sleeve 14 and power connector cap 20, a disposable fluorescent lamp holder is produced. Of course, it should be understood that fluorescent lamp 12 would be inserted into sleeve 14 and the appropriate end caps before securing same.

Figure 11:
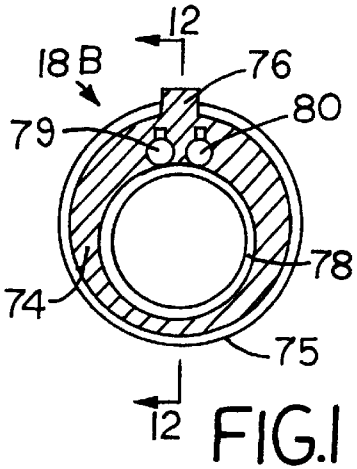
FIG. 11 is a front view of another embodiment of a tube power connector cap as taken along line 11—11 of FIG. 12.
Figure 12:
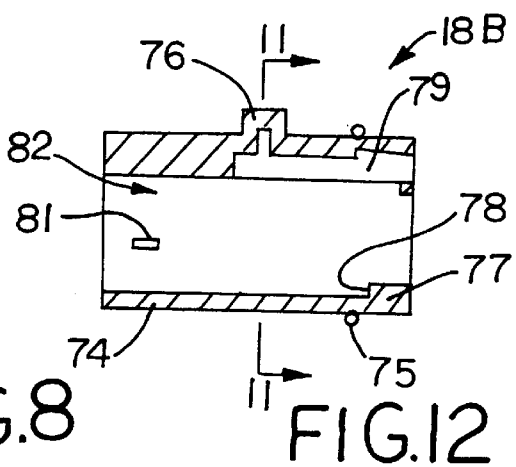
FIG. 12 is a cross-sectional side view of the tube power connector cap of FIG. 11 taken along line 12—12 thereof.
Figure 8:
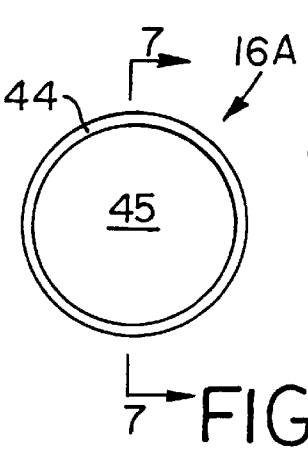
FIG. 8 is a front view of the end cap of FIG. 7 taken along line 8—8 thereof.
Figure 7:
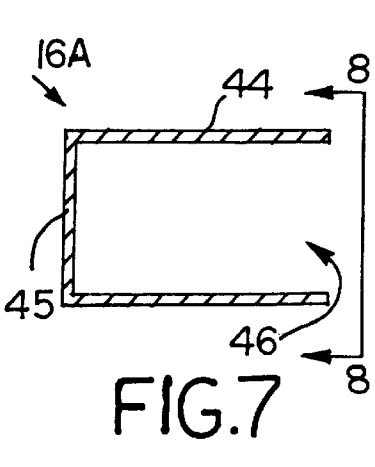
FIG. 7 is a cross-sectional view of one embodiment of an end cap as taken along line 7—7 of FIG. 8.
Figure 13:
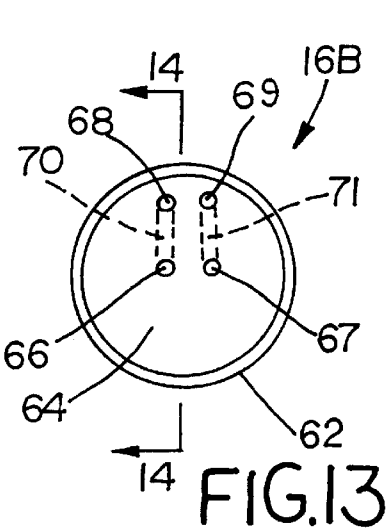
FIG. 13 is a front view of another embodiment of the end cap as taken along line 13—13 of FIG. 14.
Figure 14:
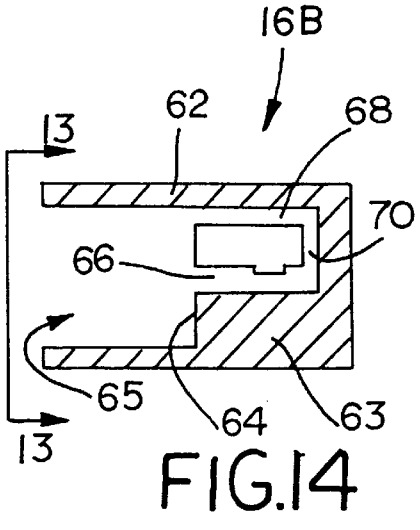
FIG. 14 is a cross-sectional side view of the end cap of FIG. 13 taken along line 14—14 thereof.

With reference now to FIGS. 11–14, there is depicted end cap 16*b* and tube power connector cap 18*b* which, along with sleeve 14 and power attachment cap 20, provide a replaceable lamp embodiment of fluorescent lamp holder 10. In particular, FIGS. 13 and 14 depict end cap 16*b*. End cap 16*b* is defined by tubular shell 62 having end portion/block 64, preferably injection-molded made from a dielectric plastic, and is sized to receive an end portion of sleeve 14 and fluorescent lamp 12 within opening 65. Fluorescent lamp terminal/prong bores 66 and 67 are disposed in block 63 from front surface 64. Additionally, electrical lead bores 68 and 69 are disposed in block 63 from front surface 64 and are in communication with fluorescent lamp terminal/prong bores 66 and 67 by lateral bores 70 and 71 respectively. This allows the electrical leads (not shown) extending through bore 25 of sleeve 14 to be electrically connected to the fluorescent lamp terminals/prongs (not shown) that are received in fluorescent lamp terminal/prong bores 66 and 67. Preferably, end cap 16*b* is permanently attached to sleeve 14 via glue, sonic welding, or the like. For replacement, the old fluorescent lamp is easily removed from end cap 16*b* which carries the terminal receptacles 66 and 67, while a new fluorescent lamp is easily installed into bores 66 and 67 of end cap 16*b* by pressure. Sleeve 14 remains attached to end cap 16*b*.

FIGS. 11 and 12 depict tube power connector cap 18*b*, preferably injection-molded made from a dielectric plastic, which is defined by cylindrical shell 74. Tube power connector cap 18*b* has internal cavity 82 sized and dimensioned to receive fluorescent lamp 12 and sleeve 14. Adjacent an end thereof is radial ledge 77 which defines a front surface 78 that provides a stop for sleeve 14. Tube power connector cap 18*b* further includes electrical lead bores 79 and 80 that allow the electrical leads emanating from power attachment cap 18 to extend therein and feed through shaft 25 of sleeve 14 to couple with the fluorescent lamp terminals/prongs disposed within end cap 16*b*. Preferably, tube power connector cap 18*b* is permanently attached as by glue, sonic weld, or the like to sleever 14 and when assembled, abuts power attachment cap 20. In this regard, tube power connector cap 18*b* has radially outward notch 76 that provides a stop and abuts notch 35 of power attachment cap 20. Additionally, O-ring 75 is provided for sealing as power attachment cap 20 extends over and around tube power connector cap 18*b* via opening 43. Two openings, of which one opening 81 is shown, provides attachment points for attachment clip 28 if used.

For replacement of an old fluorescent lamp carried within the replaceable embodiments of the present lamp holder 10, power connector cap 20 is removed from tube power connector cap 18*b* which disengages the terminals/prongs of the old fluorescent lamp from bores 38*a* and 38*b*. The old fluorescent lamp that thus extends from tube power connector cap 18*b* is pulled therefrom also disengaging the other terminals/prongs from bores 66 and 67 of end cap 16*b*. A new fluorescent lamp is inserted through tube power connector cap 18*b* such that one set of terminals/prongs engage bores 66 and 67 in end cap 16*b*. Thereafter, power connector cap 20 is engaged over tube power connector cap 18*b*.

Figure 15:
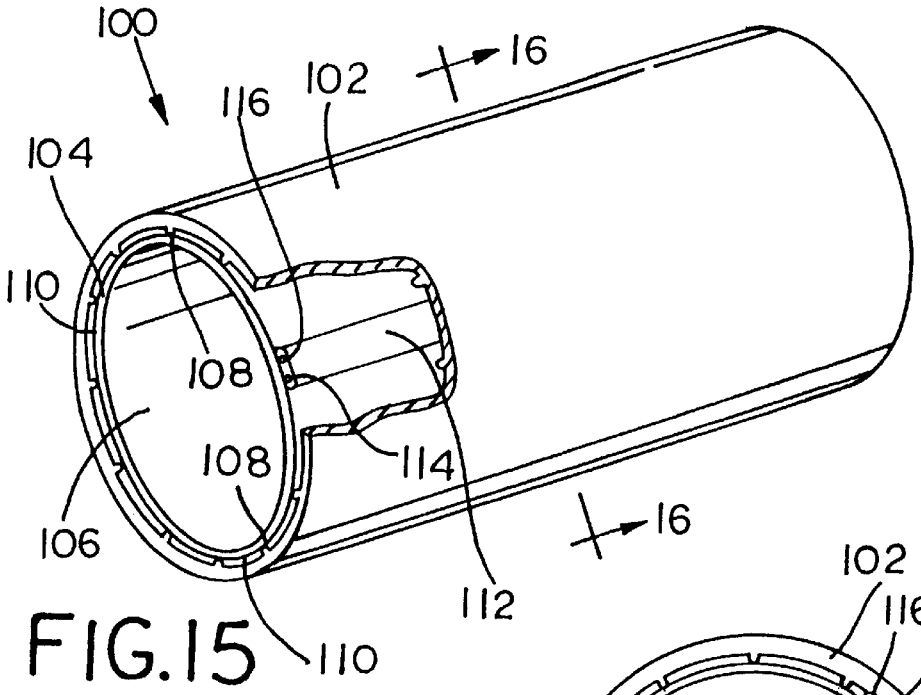
FIG. 15 is an enlarged perspective view of a section of an alternative embodiment of a protective sleeve structure with a portion of the protective sleeve structure in cutaway showing an electrical conductor extending therethrough.
Figure 16:
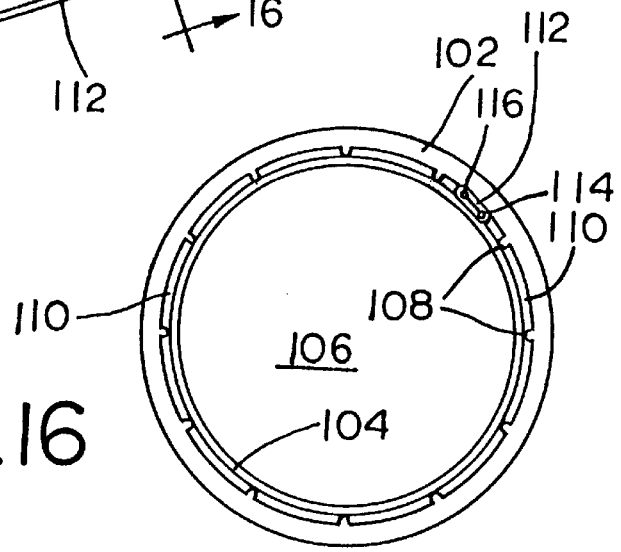
FIG. 16 is a sectional view of the protective sleeve structure of FIG. 15 taken along line 16—16 thereof.

Referring now to FIGS. 15 and 16 there is shown an alternative embodiment of a protective sleeve structure generally designated 100 that may be used in place of protective sleeve 14 and, as well, preferably made of a light-transmissive plastic. Protective sleeve structure 100 includes outer tube or sleeve 102 radially surrounding inner tube or sleeve 104 with inner tube 102 defining fluorescent lamp cavity 106 therein. Outer tube 102 includes a plurality of ribs or spacers 108. Ribs 108 are disposed on an inner diameter thereof and radially inwardly protrude from the inner diameter of outer tube 102. Ribs 108 preferably extend the longitudinal length of outer tube 102, however, ribs 108 may take any pattern on the inner diameter of outer tube 102 in accordance with the principles of the present invention. Ribs 108 are preferably formed integral with tube 102 such as by extrusion and are sized to abut an outer diameter of inner tube 104. In addition, ribs 108 help define with the inner diameter of outer tube 102 and the outer diameter of inner tube 104 a plurality of chambers 110. Chambers 110 provide insulation pockets of air that preferably extend the longitudinal length of protective sleeve 100. Of course, the configuration of chambers 110 depends on the configuration of ribs 108.

Additionally, protective sleeve structure 100 includes conductor 112 having first lead 114 and second lead 116 that extends within one chamber 110 and electrically connects the end caps as described above.

Figure 17:
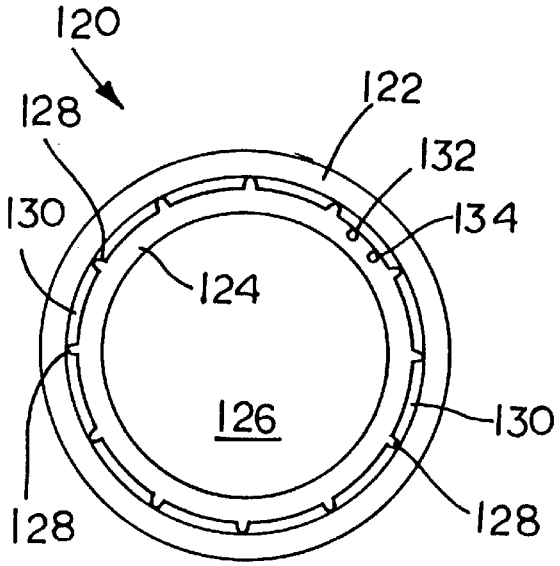
FIG. 17 is a sectional view of an alternative embodiment of the protective sleeve structure of the present invention.

With reference now to FIG. 17 there is shown a sectional view of an alternative embodiment of a protective sleeve structure generally designated 120. Protective sleeve structure 120 has outer tube 122 and inner tube 124 both preferably made from a light-transmissive plastic. Inner tube 124 defines fluorescent lamp cavity 126 and includes a plurality of radially outwardly extending ribs or spacers 128 on the outer diameter thereof. Ribs 128 are sized to abut the inner diameter of outer tube 122 and define with the outer diameter of inner tube 124 and the inner diameter of outer tube 122 a plurality of chambers 130. Ribs 128 and thus chambers 130 preferably extend the longitudinal length of protective sleeve structure 120. Chambers 130 provide pockets of air regions between inner tube 124 and outer tube 122 that are insulative in nature.

In addition, disposed in inner tube 124 is first conductor 132 and second conductor 134. First and second conductors 132 and 134 are electrically conducting strips that are molded into inner sleeve 124 and extend the longitudinal length of protective sleeve structure 120 to couple to the particular end caps for distributing electricity to the ends of the fluorescent lamp.

Figure 18:
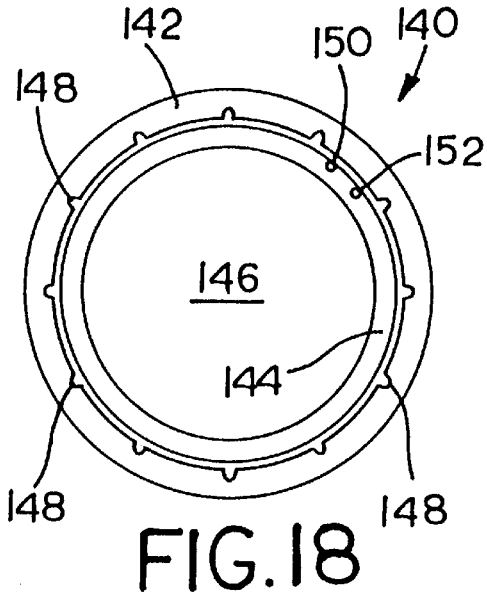
FIG. 18 is a sectional view of a further alternative embodiment of the protective sleeve structure of the present invention.

With reference now to FIG. 18 there is depicted a sectional view of yet another alternative embodiment of a protective sleeve structure generally designated 140. Protective sleeve structure 140 has outer tube 142 and inner tube 144 both preferably made from a light-transmissive plastic. Inner tube 144 defines fluorescent lamp cavity 146 and is essentially coaxial with outer tube 142. Outer tube 142 includes a plurality of folds, creases, or the like 148 in the inner diameter thereof that are radially spaced from each other. Each crease 148 preferably extends the longitudinal length of protective sleeve structure 140 and of themselves, each define an air chamber. The air chambers provide thermal insulation for the fluorescent lamp. It should be understood that the geometry of the creases may differ from that shown.

Additionally, outer tube 142 carries first electrical conductor 150 and second electrical conductor 152. First and second conductors 150 and 152 are electrically conducting strips that are molded into outer tube 142 as by extrusion and extend the longitudinal length of protective sleeve structure 140 to couple to the particular end caps for distributing electricity to the ends of the fluorescent lamp.

Figure 19:
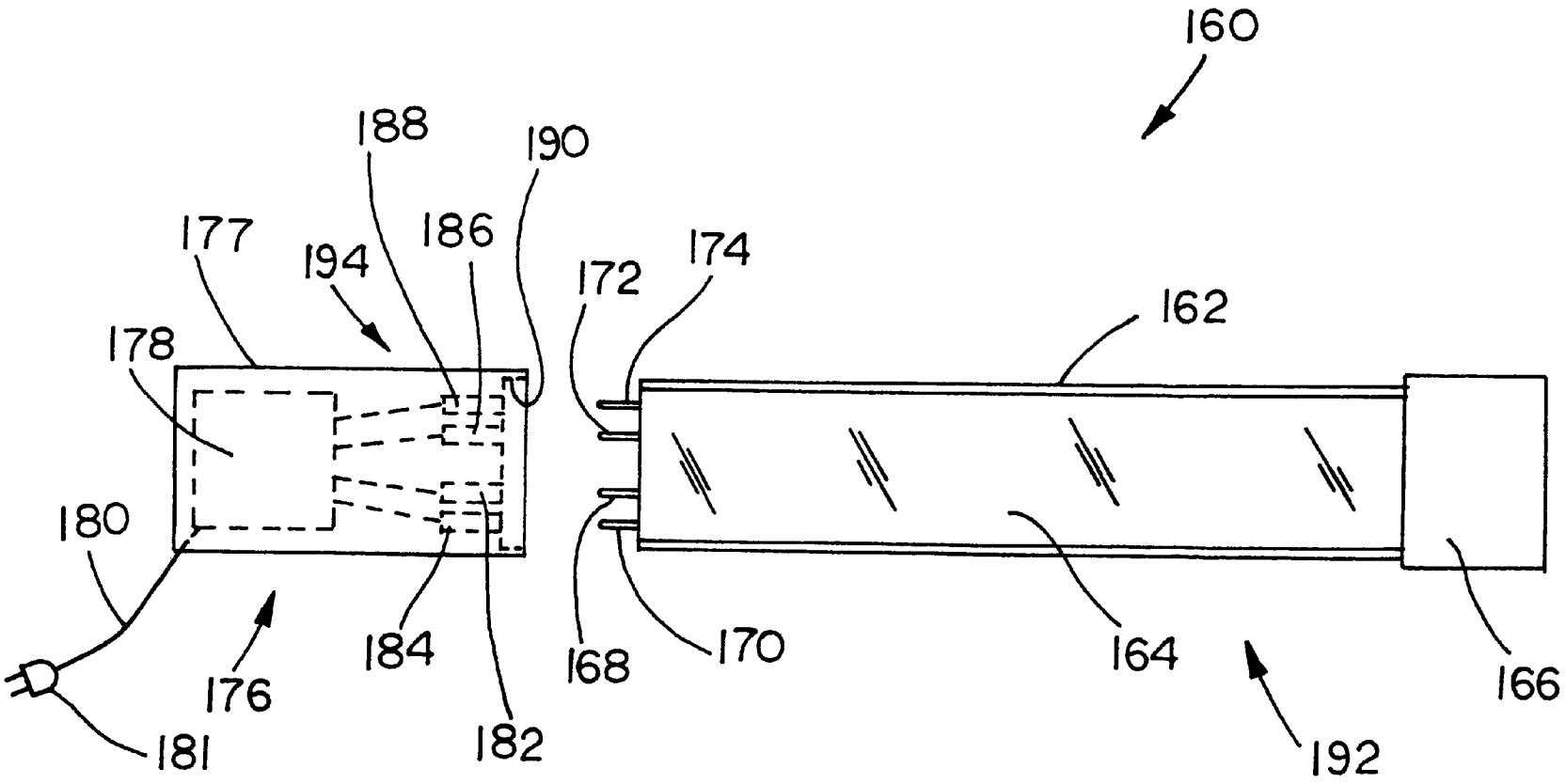
FIG. 19 is a side view of an alternative lamp assembly wherein the power end cap includes an integral ballast.

With attention now to FIG. 19, there is shown another alternative embodiment of a fluorescent lamp assembly 160. Fluorescent lamp assembly 160 has outer tube or sheath 162 that houses and/or surrounds fluorescent lamp 164. One end of outer tube 162 and one end of fluorescent lamp 164 are received in end cap 166. Fluorescent lamp 164 has two conducting leads or prongs 168 and 170 on one end thereof that extend from and beyond outer tube 162. Two other like conducting leads or prongs (not seen) are disposed on the other end of fluorescent lamp 164 and are received in terminal receptacles (not shown) in end cap 166. Extending the length of outer tube 162 in a manner as described above, are conductors that provide electrical coupling between one side of fluorescent lamp 164 and the other side of fluorescent lamp 164 and/or a ballast. At one end, the conductors terminate in prongs 172 and 174, while at the other end, the conductors terminate in electrical contact with the terminal receptacles (not shown) of end cap 166.

Fluorescent lamp assembly 160 is also characterized by end cap 176 formed by body 177. Preferably, body 177 is a one-piece plastic injection molded component incorporating the features described below. End cap 176 releasably receives the end of fluorescent lamp subassembly 192 opposite end cap 166. End cap 176 is formed about ballast 178 so as to be integral therewith. Ballast 178 is coupled to electrical cord 180 that extends a suitable distance from body 177. Ballast 178 may be any suitable, generally known ballast as is appropriately used for fluorescent lamp excitation. Electrical cord 180 includes plug 181 of the type adapted to be received in a suitable standard electrical outlet. Ballast 178 is coupled appropriately via wires 194 to receptacles 182, 184, 186, and 188 formed in body 177 and in communication with end surface 196 of body 177. The interior of each receptacle 182, 184, and 188, or receptacle well, is shrouded to discourage electrical "creepage or arc tracking" and to allow the receptacle to flex. Receptacles 182 and 184 receive prongs 168 and 170, respectively, of fluorescent tube 164 while receptacles 186 and 188 receive prongs 172 and 174, respectively, of the conductor strip extending from end cap 166. It should be understood that wires 194 are shown in simplified form and, as such, the exact wiring diagram is not intended to be nor is it shown. Extending axially from an annular periphery of end surface 196 is annular shroud 190. Annular shroud 190 defines a bore in end cap 176 and is sized to annularly fit over or receive outer sheath 162 as the fluorescent lamp subassembly 192 is received on end cap 176. End cap 176 is preferably watertight and formed as the other watertight end caps described herein and fits over outer sheath 162 in a preferably watertight manner.

By integrating ballast 178 into end cap 176, high frequency and high voltages generated in the ballast necessary to power fluorescent lamp 164 are confined to a small area. Such a structure allows heat generated by ballast 178 to be conducted to fluorescent lamp 164, thereby enabling the fluorescent lamp to function in a colder environment and/or better in a less cold environment. The present structure is also less likely to allow electrical arcing during unplugging of end cap 176 from subassembly 192 during replacement thereof. Additionally, replacement time and labor are decreased. The integrated ballast also allows for easier and quicker assembly of the fluorescent lamp assembly. Further, wiring problems for installation of the fluorescent lamp assembly are alleviated.

It should also be understood that other fluorescent lamp configuration may utilize the present invention. As well, the type and number of terminal(s) on the fluorescent lamp may vary and still utilize the present invention with minor modification(s).

While this invention has been described as having preferred designs, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A fluorescent lamp holder assembly for a fluorescent lamp therein, the fluorescent lamp having a first set of terminals on one end thereof and a second set of terminals on another end thereof, the fluorescent lamp holder assembly comprising:

a light transmissive sleeve structure having a first light transmissive tube adapted to receive the fluorescent lamp therein, a second light transmissive tube radially surrounding said first tube, and a plurality of air chambers disposed between said first and second tubes, said first and second tubes defining a first end and a second end;

a first end cap having a bore adapted to receive said first end, and first and second terminal receptacles adapted to receive the first set of terminals of the fluorescent lamp;

a second end cap having a bore therein adapted to receive said second end, and first and second terminal receptacles adapted to receive the second set of terminals of the fluorescent lamp; and first and second electrical leads extending respectively from said first and second terminal receptacles of said first end cap to said first and second terminal receptacles of said second end cap.

2. The fluorescent lamp holder assembly of claim 1, wherein said plurality of air chambers are defined by a plurality of spacers.

3. The fluorescent lamp holder assembly of claim 2, wherein said plurality of spacers comprise ribs formed on an inside diameter of said second tube.

4. The fluorescent lamp holder assembly of claim 3, wherein said ribs extend substantially the longitudinal length of said second tube.

5. The fluorescent lamp holder assembly of claim 2, wherein said plurality of spacers comprise ribs formed on an outside diameter of said first tube.

6. The fluorescent lamp holder assembly of claim 5, wherein said ribs extend substantially the longitudinal length of said first tube.

7. The fluorescent lamp holder assembly of claim 1, wherein said first and second leads are disposed in one of said air chambers.

8. The fluorescent lamp holder assembly of claim 1, wherein said first and second leads are formed integral with one of said first and second tubes.

9. The fluorescent lamp holder assembly of claim 1, wherein said air chambers are defined by a plurality of pleats in one of said inner surface of said outer tube and said outer surface of said inner tube.

10. The fluorescent lamp holder assembly of claim 9, wherein said plurality of pleats are formed on an outside diameter of said first tube.

11. The fluorescent lamp holder assembly of claim 10, wherein said pleats extend substantially the longitudinal length of said first tube.

12. The fluorescent lamp holder assembly of claim 9, wherein said pleats are formed on an inside diameter of said second tube.

13. The fluorescent lamp holder assembly of claim 12, wherein said pleats extend substantially the longitudinal length of said second tube.

14. A fluorescent lamp holder assembly for a fluorescent lamp, the fluorescent lamp having a first pair of terminals on one end thereof and a second pair of terminals on another end thereof, the fluorescent lamp holder assembly comprising:

a light transmissive sleeve structure having an inner tube adapted to receive the fluorescent tube therein, an outer tube radially about said inner tube, and a plurality of chambers disposed between an outer surface of said inner tube and an inner surface of said outer tube, said inner and outer tubes defining a first end and a second end;

a first end cap having a bore adapted to receive said first end, and first and second terminal receptacles adapted to receive the first pair of terminals of the fluorescent lamp;

a second end cap having a bore therein adapted to receive said second end, and first and second terminal receptacles adapted to receive said second pair of terminals of the fluorescent lamp; and first and second electrical conductors extending from said first and second terminal receptacles of said first end cap to said first and second terminal receptacles of said second end cap.

15. The fluorescent lamp holder assembly of claim 14, wherein said plurality of chambers are defined by a plurality of spacers.

16. The fluorescent lamp holder assembly of claim 15, wherein said plurality of spacers comprise radially outwardly extending ribs on the outer diameter of said inner tube.

17. The fluorescent lamp holder assembly of claim 15, wherein said plurality spacers comprise radially inwardly extending ribs on the inner diameter of said outer tube.

18. The fluorescent lamp holder assembly of claim 14, wherein said first and second conductors are disposed in one of said chambers.

19. The fluorescent lamp holder assembly of claim 14, wherein said first and second conductors are formed integral with one of said inner and outer tubes.

20. The fluorescent lamp holder assembly of claim 14, wherein said chambers are defined by a plurality of pleats in one of said inner surface of said outer tube and said outer surface of said inner tube.

21. A fluorescent lamp holder assembly for a fluorescent lamp, the fluorescent lamp having at least one terminal on one end thereof and at least one terminal on another end thereof, the fluorescent lamp holder assembly comprising:

a light transmissive sleeve structure having an inner tube adapted to receive the fluorescent tube therein and an outer tube radially about said inner tube, said inner and outer tubes defining a first end a second end;

a first end cap having a bore and at least one terminal receptacle, said bore adapted to receive said first end therein, each said terminal receptacle adapted to receive one of the terminals of the fluorescent lamp;

a second end cap having a bore and at least one terminal receptacle, said bore adapted to receive said second end therein, each said terminal receptacle adapted to receive one of the terminals of the fluorescent lamp; and at least one electrical conductor, each said electrical conductor disposed between said inner tube and said outer tube and extending from a terminal receptacle of said first end cap to a terminal receptacle of said second end cap.

22. A fluorescent lamp holder assembly for a fluorescent lamp, the fluorescent lamp having at least one terminal on one end thereof and at least one terminal on another end thereof, the fluorescent lamp holder assembly comprising:

a light transmissive sleeve having a first end and a second end, and adapted to surround at least a portion of the fluorescent lamp;

a first end cap adapted to receive said first end of said light transmissive sleeve and one end of the fluorescent lamp, said first end cap adapted to allow external electrical coupling to the at least one terminal of one end of the fluorescent lamp; and a second end cap having a bore therein adapted to be releasably received over a portion of said light transmissive sleeve, at least one receptacle adapted to releasably receive at least one terminal of another end of the fluorescent lamp, and a ballast electrically coupled to said at least one receptacle of said second end cap and adapted to be electrically coupled to the at least one terminal within said first end cap.

23. The fluorescent lamp holder assembly of claim 22, wherein said ballast is formed integrally within said second end cap, and coupled to an external power cord.

24. The fluorescent lamp holder assembly of claim 23, wherein said second end cap is injection molded about said ballast.

25. The fluorescent lamp holder assembly of claim 22, wherein said second end cap includes an annular axially extending shroud defining said bore.

26. A fluorescent lamp holder assembly for a fluorescent lamp, the fluorescent lamp having at least a pair of terminals on one end thereof and a pair of terminals on another end thereof, the fluorescent lamp holder assembly comprising:

a light transmissive sleeve having first and second ends, and adapted to at least partially surround the fluorescent lamp;

an end cap adapted to receive one of said first and second ends of said light transmissive sleeve and to electrically receive a pair of terminals of one end of the fluorescent lamp and to provide external electrical coupling thereto; and a power cap adapted to releasably receive another of said first and second ends and having a pair of lamp receptacles adapted to releasably receive a pair of terminals of another end of the fluorescent lamp, said power cap having a ballast therein electrically coupled to said pair of lamp receptacles and electrically couplable to a source of electric power and said pair of terminals within said end cap.

27. The fluorescent lamp assembly of claim 26, wherein said power cap is injection molded about said ballast and said pair of lamp receptacles.

28. The fluorescent lamp assembly claim 26, wherein said power cap further includes a pair of distribution receptacles electrically coupled to said ballast, and light transmissive sleeve carries an electric conductor coupled at one end to the pair of terminals of one end of the fluorescent lamp within said end cap and terminates in a pair of prongs on another end thereof, said pair of prongs adapted to be releasably retained in said pair of distribution receptacles.

29. The fluorescent lamp assembly of claim 28, wherein said power cap includes a bore defining an annular axially extending rim adapted to surround a portion of said light transmissive sleeve, and an end surface, said distribution receptacles and said pair of lamp receptacles disposed in said end surface.

* * * * *

UNITED STATES PATENT AND TRADEMARK OFFICE

CERTIFICATE OF CORRECTION

PATENT NO. : 6,193,534 B1
DATED : February 27, 2001
INVENTOR(S) : John W. Burwell, et al.

It is certified that error appears in the above-identified patent and that said Letters Patent is hereby corrected as shown below:

Column 1,
Line 7, delete "copending" and substitute -- co-pending -- therefor.
Line 19, delete "exited" and substitute -- excited -- therefor.

Column 4,
Line 5, after "cross-sectional" insert -- side -- therefor.

Column 5,
Line 33, after "8" insert -- depict -- therefor.
Line 38, delete "15" and insert -- 25 -- therefor.

Column 6,
Line 64, delete "embodiments" and substitute -- embodiment -- therefor.

Column 8,
Line 47, after "184" insert -- 186 -- therefor.

Column 9,
Line 12, delete "configuration" and substitute -- configurations -- therefor.

Column 12,
Line 27, after "assembly" insert -- of -- therefor.

Signed and Sealed this

Twentieth Day of November, 2001

*Attest:*

Nicholas P. Godici

*Attesting Officer*

NICHOLAS P. GODICI
*Acting Director of the United States Patent and Trademark Office*